US005188055A

United States Patent [19]

Kershner

[11] Patent Number: 5,188,055

[45] Date of Patent: Feb. 23, 1993

[54] ADJUSTABLE BOAT ANCHOR

[76] Inventor: Gary P. Kershner, P.O. Box 638, Bokeelia, Fla. 33922

[21] Appl. No.: 817,762

[22] Filed: Jan. 8, 1992

[51] Int. Cl.[5] ..... B63B 21/32

[52] U.S. Cl. ..... 114/299; 114/301

[58] Field of Search ..... 114/294, 297, 299, 300, 114/301, 304

[56] References Cited

U.S. PATENT DOCUMENTS

| | | | |
|---|---|---|---|
| 551,125 | 12/1895 | Langley et al. | 114/304 |
| 2,507,563 | 5/1950 | Farren | 114/304 |
| 4,602,588 | 7/1986 | Maclean | 114/301 |

FOREIGN PATENT DOCUMENTS

| | | | |
|---|---|---|---|
| 1100518 | 1/1968 | United Kingdom | 114/299 |
| 8909722 | 10/1989 | World Int. Prop. O. | 114/301 |

*Primary Examiner*—Sherman Basinger
*Attorney, Agent, or Firm*—William E. Noonan

[57] ABSTRACT

A boat anchor is disclosed including a fluke, having a relatively pointed tip portion and a relatively broad tail portion disposed rearwardly of the tip portion. A shank is fixed to the fluke rearwardly of the tip portion and extends forwardly of the tip portion to a distal end. The shank includes a generally longitudinal slot that extends from a first end proximate the distal end of the shank to an opposite second end located rearwardly of the anchor's center of gravity. The slot is slidably engageable by an anchor line and allows the anchor line to slide between the first end of the slot, wherein force may be exerted on the line to embed the tip of the fluke into the ground, and the second end of the slot, wherein force may be exerted on the line to pull the tip portion of the anchor out of the ground.

20 Claims, 2 Drawing Sheets

ADJUSTABLE BOAT ANCHOR

FIELD OF THE INVENTION

This invention relates to an adjustable boat anchor and, more particularly, to a readily retrievable boat anchor that may be varied in weight and size for serving various sizes of vessels.

BACKGROUND OF THE INVENTION

Boat anchors are conventionally carried at the end of a long chain or other type of line. Many such anchors employ a fluke that is embedded into the sea floor to temporarily anchor the vessel. Unfortunately, because the anchor is usually attached to the line at a fixed point, it is often quite difficult to achieve the leverage and force necessary to properly lodge the anchor into the ground. Likewise, it can be awkward and difficult to dislodge and retrieve the anchor before resuming travel.

In an attempt to alleviate this problem, certain anchors have employed a slotted shank that permits the position of the anchor chain to be adjusted to improve the leverage on the anchor. However, these anchors often do not exhibit optimally reliable operation. Typically, the shank is pivotally attached to the fluke so that the angle between the shank and the fluke may be adjusted. When the anchor is retrieved, the chain slides to the forward end of the slot. As a result, the fluke and the shank pivot closed such that the forward end of the slot and the attached chain are located behind the anchor's center of gravity. In fact, at least one known device, disclosed in U.S. Pat. No. 2,468,077, explicitly requires that the slot stop three inches short of the center of gravity of the anchor, so that the anchor automatically resets after it is retrieved. Because of this slot position, the majority of the anchor's weight is located forwardly of the chain. As a result, the tip of the fluke tends to dig into the ground and resists being retrieved. Moreover, conventionally designed flukes are relatively lightweight and are apt to unintentionally dislodge from the sea floor. Known plow-type anchors also tend to tip sideways as they are embedded in the sea floor, which makes them difficult to set. And most conventional anchors are usually suitable for use on only certain limited sizes of vessels.

SUMMARY OF INVENTION

It is therefore an object of this invention to provide an adjustable boat anchor, which is readily, reliably and securely embedded in the sea floor and which effectively resists unintentional dislodging.

It is a further object of this invention to provide an adjustable boat anchor that is quickly and conveniently dislodged from the sea floor when intended so that the anchor may be retrieved.

It is a further object of this invention to provide an adjustable boat anchor that may be readily adjusted in weight so that it is adaptable for use with various sizes of boats.

It is a further object of this invention to provide an adjustable boat anchor that resists entanglement with the anchor chain.

It is a further object of this invention to provide a boat anchor that may be deployed by chain, rope or other types of line.

It is a further object of this invention to provide a boat anchor that is rugged, long-lasting and corrosion resistant.

This invention results from a realization that a plow-type boat anchor will exhibit improved operation if it is provided with an elongate slotted shank for slidably accommodating the anchor line and that such an anchor is much easier to dislodge from the sea floor if the slot in the shank is extended to a point located rearwardly of the anchor's center of gravity. Such positioning allows the anchor to tip forwardly as it is dislodged so that leverage is improved and retrieval of the anchor is facilitated. This invention results from a further realization that such an anchor may be utilized for various sizes of boats by employing a fluke chamber that permits the weight of the anchor to be adjusted as required.

This invention features a boat anchor that includes a fluke having a relatively pointed tip portion and a relatively broad tail portion disposed rearwardly of the tip portion. A shank is fixed to the fluke rearwardly of the tip portion and extends forwardly of the tip portion to a distal end. The shank includes a generally longitudinal slot that extends from a first end proximate the distal end of the shank to an opposite second end located rearwardly of the anchor's center of gravity. The slot is slidably engaged by an anchor line and allows the anchor line to slide between the first end of the slot, wherein force may be exerted on the line to embed the tip portion of the fluke into the ground and a second end of the slot, wherein force may be exerted on the line to pull the tip portion of the anchor out of the ground.

In a preferred embodiment, the anchor further includes a chamber carried by the fluke and having means for selectively introducing weight into and removing weight from the chamber to adjust the weight of the anchor. The chamber is preferably disposed forwardly of the second end of the shank slot and proximate the tip portion of the fluke. The fluke may include an upper surface having a generally convex region and lower surface having a generally concave region. Typically, the shank is fixed to the upper surface portion of the fluke and the chamber is carried by the lower surface portion. The fluke may include a peripheral flange that is formed on the upper surface and extends about at least the tail portion of the fluke. Preferably, the fluke and the shank include a corrosion-resistant outer surface.

DETAILED DESCRIPTION OF PREFERRED EMBODIMENTS

Other objects, features and advantages will occur from the following description of a preferred embodiment and the accompanying drawings in which.

Figure 1:
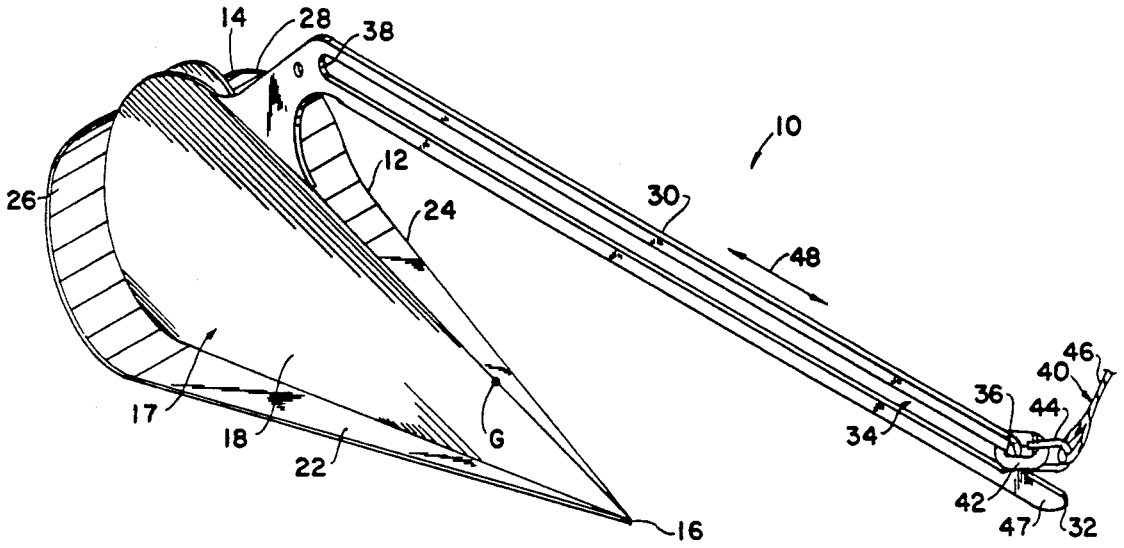
FIG. 1 is an upper, front perspective view of the boat anchor of this invention.

The boat anchor of this invention utilizes a generally plow-type anchor fluke having a broad tail portion and a relatively pointed tip portion that is disposed forwardly of the tail portion. The fluke is formed of cold rolled steel or similar rugged material. It is preferably constructed such that it includes a generally convex region in its upper surface and a generally concave region in its lower surface. A peripheral flange, formed on the upper surface, typically extends about the tail portion of the fluke. This flange assists the anchor to embed into the sea floor, as described more fully below.

A shank is welded or permanently fixed in some other suitable fashion to the fluke rearwardly of the tip portion. Preferably, the shank is secured to the upper surface of the fluke and extends forwardly of the tip portion to a distal end. The shank includes a generally longitudinal slot extending from a first end proximate the distal end of the shank to an opposite second end located rearwardly of the anchor's center of gravity. An appropriate anchor line is slidably engaged with the slotted shank by means of a link, shackle or other similar terminal element. The anchor line may comprise a chain, rope or other known types of line capable of manipulating an anchor. Preferably, the distal end of the shank includes an extension member that is larger than the opening in the terminal link or other element that engages the slotted shank. This restricts the terminal element from passing over the distal end of the shank. As a result, the anchor line does not become entangled with the shank.

The weight and center of gravity of the anchor may be defined solely by the weight of the fluke and shank. However, it is preferred that the anchor include a chamber carried by the fluke for selectively receiving weighted materials so that the weight and center of gravity of the anchor may be adjusted. This chamber is typically carried by the lower surface of the fluke and includes an opening, inlet, port or other means for selectively introducing weight into and removing weight from the chamber. This chamber may be welded or otherwise permanently secured to the fluke. The opening is selectively closed by a suitable cap or other type of closure. Lead shot or similar material is used as the weight. Typically, the chamber is disposed largely forward of the second end of the shank slot and proximate the tip portion of the fluke. The amount of weight that is added can be varied as required from zero to twenty-five pounds or more, depending upon the size of the anchor and chamber that are employed.

As with the fluke, the shank and chamber are preferably constructed of steel or similar rugged material. The longevity of the anchor is improved considerably by providing each of these elements with a corrosion-resistant surface. For example, the surfaces may be provided with a coating of zinc or similar corrosion-resistant material such that the anchor is capable of withstanding at least 5,000 hours in a salt water environment.

Due to the unique structural features employed by this boat anchor, it exhibits significant advantages over known anchors. Because the weight of the anchor may be adjusted and concentrated proximate the tip of the fluke, the anchor may be embedded securely into and retrieved readily from the sea, lake or ocean floor. As the anchor is deployed, the anchor line slides along the shank to the first distal end of the slot. This enables, the weighted tip of the anchor to effectively penetrate the ground. Mud, sand and other sea floor material are directed onto the upper surface of the fluke and held thereon by the upturned flange. As a result, the fluke resists sideways tipping and is securely set into the ground. While the anchor line is at the distal end of the shank, the extension member prevents the terminal link from entangling with the shank.

To retrieve the anchor, the anchor line is drawn along the shank to the second end of the slot and pulled upwardly toward the boat. Because the line engages the shank rearwardly of the center of gravity, the tip portion of the anchor tips downwardly and the tail portion tips upwardly. This improves leverage on the anchor and allows the tip portion to be cleanly withdrawn from the sea floor.

By varying the weight in the chamber, the weight of the anchor is adjusted so that it may be utilized for various sizes of boats and for various boating conditions. The following chart illustrates how four different sizes of anchors, constructed according to this invention, may be employed effectively for virtually all vessels up to 75 feet. In this example the four anchors have weights of 15, 30, 40 and 50 lbs., respectively, with their chambers empty. It should be noted that this chart is for illustrative purposes only and these dimensions are not limitations of this invention.

| ANCHOR SIZE | WEIGHT RANGE Chamber Empty | Chamber Full | BOAT LENGTHS ACCOMMODATED |
|---|---|---|---|
| 1 | 15 lbs. | 20 lbs. | Up to 20' |
| 2 | 30 lbs. | 40 lbs. | Up to 30' |
| 3 | 40 lbs. | 50 lbs. | Up to 45' |
| 4 | 50 lbs. | 75 lbs. | Up to 75' |

Accordingly, an empty Number 3 anchor (40 lbs.) successfully serves most 30' vessels The same anchor may be adapted for serving 45' vessels by adding an appropriate amount of weight (10 lbs.) to the chamber. Within each of the selected ranges, the weight of the anchor may be adjusted as required. Weight may be added so that the anchor is suitable for use with a larger boat and extraneous weight may be eliminated so that the anchor may be used efficiently for a smaller boat.

There is shown in FIG. 1 a boat anchor 10, according to this invention. The anchor includes a plow-type fluke 12 having a relatively broad tail portion 14 and a relatively pointed tip portion 16. The fluke is bent or folded generally along an axial segment 17 to form a convex region 18 in the upper surface and a concave region 20, FIGS. 2 and 3, in the lower surface of fluke 12. As shown in FIGS. 1, 2, 4 and 5, generally flat segments 22 and 24 extend outwardly from axial segment 17 along respective sides of fluke 12. Proximate tail portion 14, segments 22 and 24 curve upwardly to form respective flanges 26 and 28. The axial segment 17, side segments 22 and 24 and flange segments 26 and 28 may be constructed integrally from a single piece of steel or similar material. Alternatively, these segments may be welded or otherwise permanently interconnected.

As illustrated in FIG. 1, an elongate shank 30 is fixed to axial segment 17 of fluke 12 between tail portion 14 and tip portion 16. Shank 30 extends from fluke 12 to a distal end 32 forwardly of tip portion 16. The shank includes a longitudinal slot 34 that extends from a first end 36 proximate the distal end 32 of shank 12 to an opposite second end 38 that is located rearwardly of the center of gravity G of anchor 10.

An anchor line 40 is slidably engaged with shank 30 and, in particular, includes a preferably oblong terminal link element 42 that extends through slot 34. Link 42 is secured by a shackle 44 to a rope or alternative line 46, which extends to the boat. Terminal link 42 has an appropriate diameter and clearance such that it is slidable in slot 34 and along shank 30 in the directions indicated by double-headed arrow 48.

An extension member 47 is formed at distal end 32 of shank 30, beyond first end 36 of slot 34. Extension member 47 is longer than the inside diameter of link 42. As a result, the terminal link cannot pass around distal end 32 and become entangled about the bottom of the shank.

Figure 2:
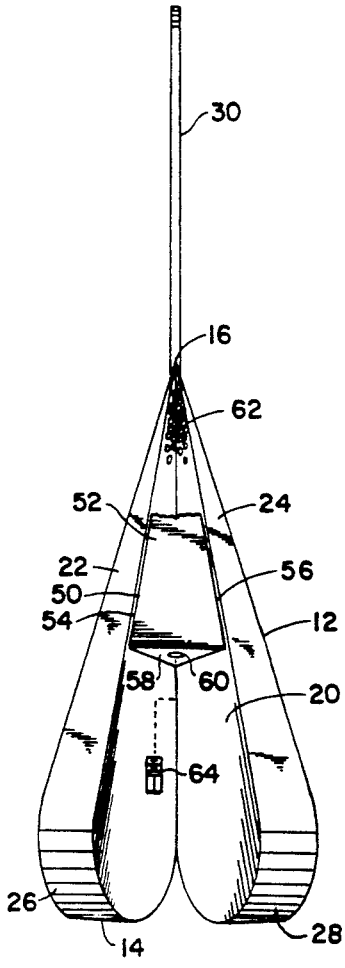
FIG. 2 is bottom plan view of the boat anchor of FIG. 1.
Figure 3:
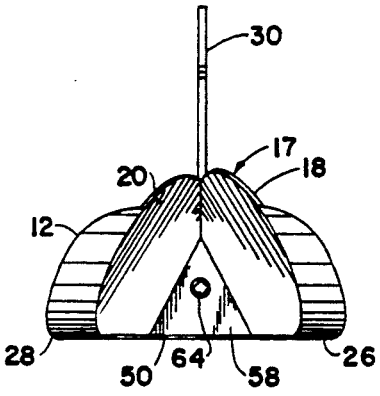
FIG. 3 is an elevational rear view of the boat anchor, which in particular illustrates the tail portion and the variable weight chamber.

As shown in FIGS. 2 and 3, a chamber 50 is carried by the concave lower surface region 20 of fluke 12. The chamber is located largely forwardly of the second end 38 of slot 34 and extends to a point proximate tip portion 16. Chamber 50 is attached directly to concave region 20 and includes a generally triangular bottom wall 52 that is permanently secured along edges 54 and 56 to concave lower surface 20. A generally triangular rearward chamber wall 58 extends between bottom wall 52 and concave region 20. A threaded opening 60 is formed into chamber 50 through rearward wall 58. Lead shot 62 or other weighted material is introduced into and removed from chamber 50 through opening 60 to adjust the weight in the chamber and, as a result, the weight of the anchor. When the proper weight is added to the chamber, a threaded cap 64 is engaged with opening 60, in the manner shown in FIG. 3, to close the chamber 52.

Figure 4:
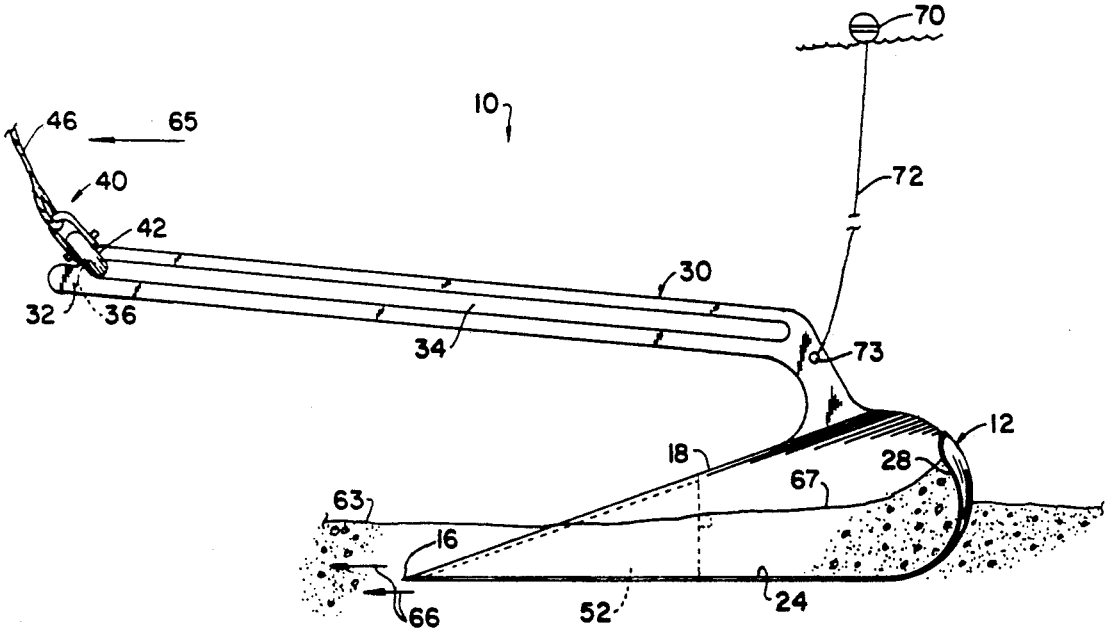
FIG. 4 is an elevational side view of the anchor set into the sea floor.

Anchor 10 is set in the manner shown in FIG. 4. Initially, the anchor is dropped from the boat, not shown, in a conventional manner. After anchor 10 strikes the bottom, the vessel is driven in the direction of arrow 65, FIG. 5, so that rope 46 pulls terminal link 42 to the first end 36 of slot 34. As the boat continues in the direction of arrow 65, the shank 30 is pulled so that the weighted tip portion 16 of fluke 12 is driven into the sea floor 63 in the direction of arrows 66. Sea floor material 67 fills the space defined by convex upper surface 18, flat segment 24 and flange 28. Such filling also occurs on the opposite side of fluke 12 in the space defined by convex surface 18, flat segment 22 and flange 26. As a result, the sea floor material weighs down fluke 12 and prevents it from tipping sideways. This permits the fluke to set securely in the sea floor 64.

When the anchor is deployed in the above manner, the vessel is held securely in place. Extension member 32 prevents terminal link 42 from passing beyond the distal end of the shank. As a result, line 40 does not become snagged when retrieval of the anchor is required. The location of the set anchor may be marked by a float 70 that is tied to shank 30 by an appropriate line 72 engaged through an opening 73 in the shank.

Figure 5:
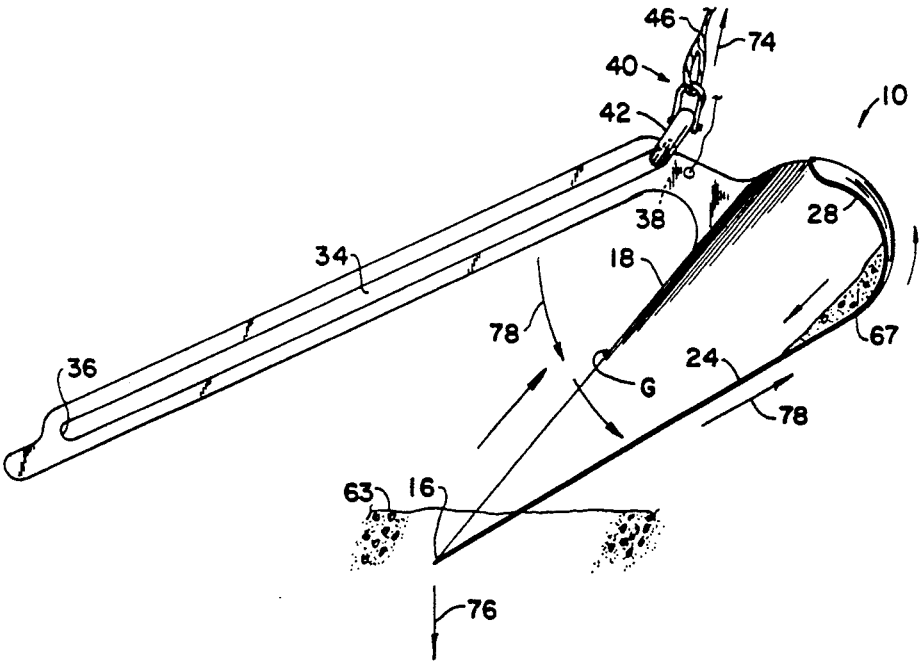
FIG. 5 is an elevational side view of the anchor being retrieved from the sea floor.

Anchor 10 is weighed in the manner shown in FIG. 5. The vessel reverses direction and draws rope 46 such that terminal link 42 is pulled to the second end 38 of slot 34. Rope 46 is then pulled upwardly in the direction of arrow 74 by hand, a winch, or other suitable means. This lifts fluke 12 from sea floor 64. Because center of gravity G is located forwardly of terminal link 42 and rope 46, the tip portion 16 of fluke 12 tips downwardly, under the force of gravity, in the direction of arrow 76 and anchor 10 pivots about center of gravity G in the direction of arrows 78. As a result, the weight of anchor 10 provides increased leverage, which assists in withdrawing tapered tip portion 16 from sea floor 63. At the same time, the tipping of the anchor causes sea floor material 67 to spill out of fluke 12, which further helps to free fluke 12 from the sea floor. In this manner, retrieval of the anchor is facilitated considerably.

Although specific features of the invention are shown in some drawings and not others, this is for convenience only, as each feature may be combined with any or all of the other features in accordance with the invention.

Other embodiments will occur to those skilled in the art and are within the following claims.

What is claimed is:

1. A boat anchor comprising:

a substantially one piece, plow-type fluke having a relatively pointed tip portion and a relatively broad tail portion disposed rearwardly of said tip portion; and a substantially once piece shank fixedly attached to said fluke rearwardly of said tip portion and being immovable relative to said fluke; said shank extending forwardly of said tip portion to a distal end and including a generally longitudinal slot that extends from a first end proximate said distal end of said shank to an opposite second end located rearwardly of the anchor's center of gravity; said slot being slidably engageable by an anchor line and allowing said anchor line to slide between said first end of said slot, wherein force may be exerted on said line to embed said tip portion of said fluke into the ground, and said second end of said slot, wherein force may be exerted on said line to pull said tip portion of said anchor out of the ground.

2. The anchor of claim 1 further including a chamber carried by said fluke and having means for selectively introducing weight into and removing weight from said chamber to adjust the weight of said anchor.

3. The anchor of claim 2 in which said chamber is proximate said tip portion.

4. The anchor of claim 2 in which said fluke includes an upper surface having a generally convex region, and a lower surface having a generally concave region.

5. The anchor of claim 4 in which said shank is fixed to said upper surface of said fluke and said chamber is carried by said lower surface of said fluke.

6. The anchor of claim 4 in which said fluke includes a peripheral flange that is formed on said upper surface and extends upwardly therefrom about at least said tail portion of said fluke to define above said upper surface a space for receiving ground material when said tip portion is embedded in the ground.

7. The anchor of claim 1 in which said chamber is disposed largely forwardly of said second end of said shank.

8. The anchor of claim 1 in which said anchor line includes, at one end, a terminal link that engages said slot, said shank including at said distal end an extension member that is larger than the opening through said terminal link to restrict said terminal link from passing over said distal end of said shank.

9. The anchor of claim 1 in which said fluke and said shank include a corrosion resistant outer surface.

10. A boat anchor comprising:

a substantially one piece, plow-type fluke having a relatively pointed tip portion and a relatively broad tail portion disposed rearwardly of said tip portion;

a chamber carried by said fluke, said chamber having means for selectively introducing weight into and removing weight from said chamber to adjust the weight of said anchor; and a substantially one piece shank fixedly attached to said fluke rearwardly of said tip portion and extending forwardly of said tip portion to a distal end and including a generally longitudinal slot that extends from a first end proximate said distal end of said shank to an opposite second end located rearwardly of the anchor's center of gravity; said slot being slidably engageable by an anchor line and allowing said anchor line to slide between said first end of said slot, wherein force may be exerted on said line to embed said tip portion of said fluke into the ground, and said second end of said slot wherein force may be exerted on said line to pull said tip portion of said anchor out of the ground;

said fluke further including upper and lower surfaces, a peripheral flange that is formed on said upper surface and extends upwardly therefrom about at least said tail portion of said fluke to define above said upper surface a space for receiving ground material when said tip portion is embedded in the ground.

11. The anchor of claim 10 in which said chamber is proximate said tip portion.

12. The anchor of claim 10 in which said fluke includes an upper surface having a generally convex region, and a lower surface having a generally concave region.

13. The anchor of claim 12 in which said shank is fixed to said upper surface of said fluke and said chamber is carried by said lower surface of said fluke.

14. The anchor of claim 12 in which said chamber includes a generally triangular bottom wall that is attached to said concave lower surface of said fluke and a generally triangular rearward wall interconnecting said lower surface and a rearward edge of said bottom wall.

15. The anchor of claim 10 in which said anchor line includes, at one end, a terminal link that engages said slot, said shank including at said distal end an extension member that is larger than the opening through said terminal link to restrict said terminal link from passing over said distal end of said shank.

16. The anchor of claim 10 in which said chamber is disposed largely forwardly of said second end of said slot.

17. The anchor of claim 10 in which said fluke and said shank include a corrosion resistant outer surface.

18. The anchor of claim 1 in which said shank includes an opening spaced apart from said slot and further including buoyant signal means that are engageable with said opening for indicating the location of said anchor beneath the water.

19. The anchor of claim 10 in which said shank includes an opening spaced apart from said slot and further including buoyant signal means that are engageable with said opening for indicating the location of said anchor beneath the water.

20. A boat anchor comprising:

a substantially one piece, plow-type fluke having a relatively pointed tip portion and a relatively broad tail portion disposed rearwardly of said tip portion; and a substantially once piece shank fixedly attached to said fluke rearwardly of said tip portion and being immovable relative to said fluke; said shank extending forwardly of said tip portion to a distal end and including a generally longitudinal slot that extends form a first end proximate said distal end of said shank to an opposite second end located rearwardly of the anchor's center of gravity; said slot being slidably engageable by an anchor line and allowing said anchor line to slide between said first end of said slot, wherein force may be exerted on said line to embed said tip portion of said fluke into the ground, and said second end of said slot, wherein force may be exerted on said line to pull said tip portion of said anchor out of the ground;

said fluke further including upper and lower surfaces, a peripheral flange that is formed on said upper surface and extends upwardly therefrom about at least said tail portion of said fluke to define above said upper surface a space for receiving ground material when said tip portion is embedded in the ground.

* * * * *